US007090467B2

(12) United States Patent
Jenks

(10) Patent No.: US 7,090,467 B2
(45) Date of Patent: Aug. 15, 2006

(54) FAN DRIVE ATTACHMENT ASSEMBLY

(75) Inventor: Jeffery D. Jenks, Oak Park, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 146 days.

(21) Appl. No.: 10/917,596

(22) Filed: Aug. 13, 2004

(65) Prior Publication Data

US 2006/0034698 A1 Feb. 16, 2006

(51) Int. Cl.
*F04D 29/044* (2006.01)

(52) U.S. Cl. ..... 416/204 R; 416/244 R; 415/229

(58) Field of Classification Search ..... 415/229; 416/244 R, 204 R
See application file for complete search history.

(56) References Cited

U.S. PATENT DOCUMENTS 2,348,293 A 5/1944 Hamer
3,485,444 A 12/1969 Linzenkirchner
3,698,750 A 10/1972 Eastcott et al.
3,796,510 A 3/1974 Korrenn et al.
3,824,807 A 7/1974 Hecht
4,066,048 A 1/1978 Premus
4,144,755 A 3/1979 Palloch
4,177,673 A 12/1979 Krueger
4,628,574 A * 12/1986 Lerman ..... 29/889.2
4,692,053 A 9/1987 Sampedro
4,936,742 A 6/1990 Eguchi et al.
5,759,074 A 6/1998 Jones
5,795,137 A 8/1998 Ozawa et al.
5,938,405 A 8/1999 Coleman
6,079,385 A 6/2000 Wicke
6,168,316 B1 1/2001 Paling et al.
6,293,704 B1 9/2001 Gradu
6,461,111 B1 * 10/2002 Haugen et al. ..... 416/244 R
6,499,958 B1 * 12/2002 Haugen et al. ..... 416/204 A

* cited by examiner

*Primary Examiner*—Ninh H. Nguyen
(74) *Attorney, Agent, or Firm*—Jeffrey P. Calfa; Dennis K. Sullivan; Susan L. Lukasik

(57) ABSTRACT

The invention is a fan drive attachment assembly for a motor vehicle that uses a tapered coupling to assemble the drive hub and fan drive together.

4 Claims, 4 Drawing Sheets

FAN DRIVE ATTACHMENT ASSEMBLY

BACKGROUND OF THE INVENTION

1. Field of the Invention

The present invention relates to a fan drive attachment assembly for a motor vehicle.

2. Description of the Prior Art

Current fan drive attachment assemblies in motor vehicles, such as for a water pump or a fan drive bearing assembly, use a drive hub with a cylindrical drive shank and fan drive with a fan shaft. The fan shaft and drive shank are designed to frictionally fit together, generally through screwing the drive shank into a cylindrical axial bore in the fan shaft.

Unfortunately the drive shank and fan shaft easily misalign, causing the drive hub and fan drive to misalign. Any misalignment between the drive hub and the fan drive can generate excessive shaking forces while the fan is running. This shaking reduces the life of the fan drive or the fan drive bearing.

There are two different ways the drive shank and fan hub misalign. The first way to misalign is radial runout. Radial alignment of the fan drive with the drive hub is typically controlled by a threaded engagement between the drive shank and the fan shaft. Thread clearance can allow parallel alignment of the drive hub and the fan drive to be parallel, but not on the same axial line.

The second type of misalignment is axial misalignment. Current fan drive attachment assemblies require the mounting faces of the drive hub and fan drive to be parallel to the centerline of the drive hub and the fan drive. Machining error, debris, such as paint, rust, and the like, can cause angular misalignment of the fan drive as it is installed. Misthreading during insertion could also cause an angular misalignment.

Therefore, it would be advantageous to design a fan drive attachment assembly to reduce the possibility of misalignment of the drive hub and fan drive, yet is easy to assemble.

SUMMARY OF THE INVENTION

According to the invention there is provided a fan drive assembly and a fan drive attachment assembly for a motor vehicle, such as a medium or heavy duty truck. The fan drive attachment assembly has a drive hub and a fan shaft. The drive hub has an outwardly extending tapered drive shank. The fan shaft has a mouth, and an inner wall extending inwardly from the mouth and defining an axial bore. The inner wall is tapered and frictionally engages the drive shank.

The fan drive assembly has a drive hub, a fan drive with a fan shaft, and a fan. The drive hub has an outwardly extending tapered drive shank. The fan shaft has a mouth and an inner wall that extends from the mouth and defines an axial bore. The inner wall is tapered and frictionally engages the drive shank.

Additional effects, features and advantages will be apparent in the written description that follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
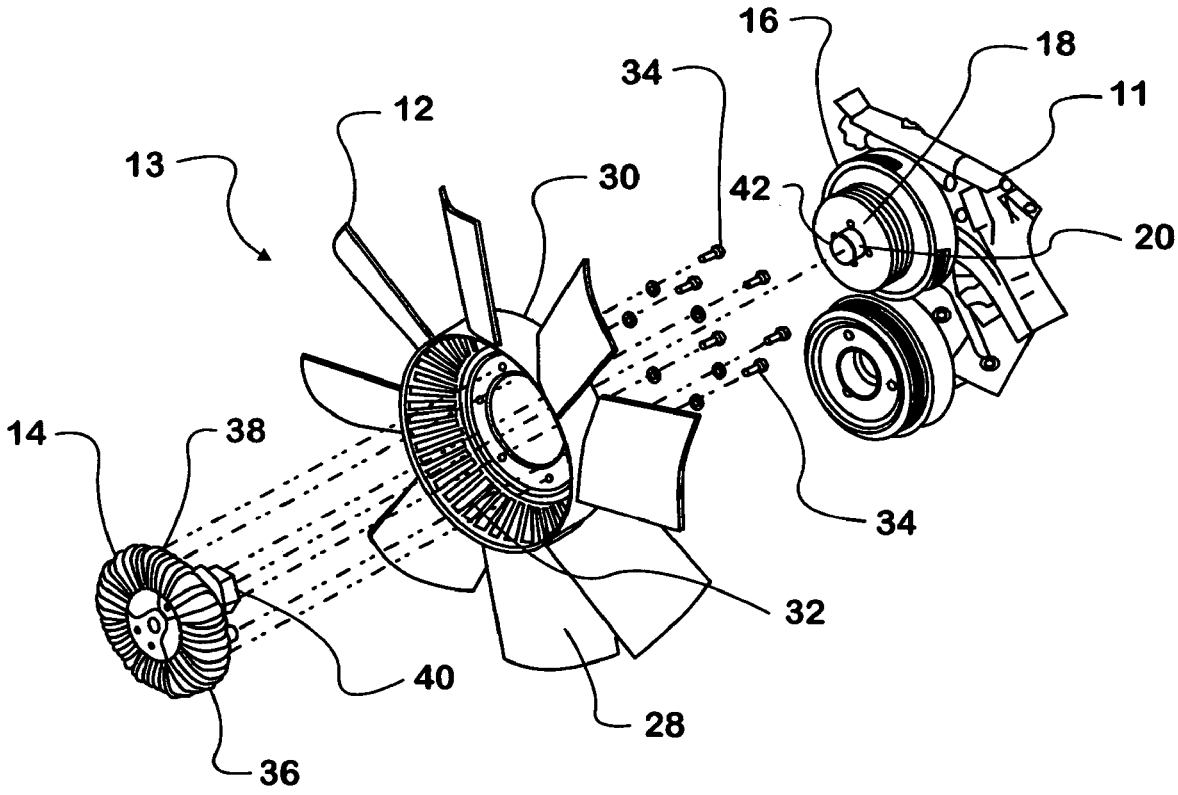
FIG. 1 is an exploded perspective view of a fan assembly.
Figure 2:
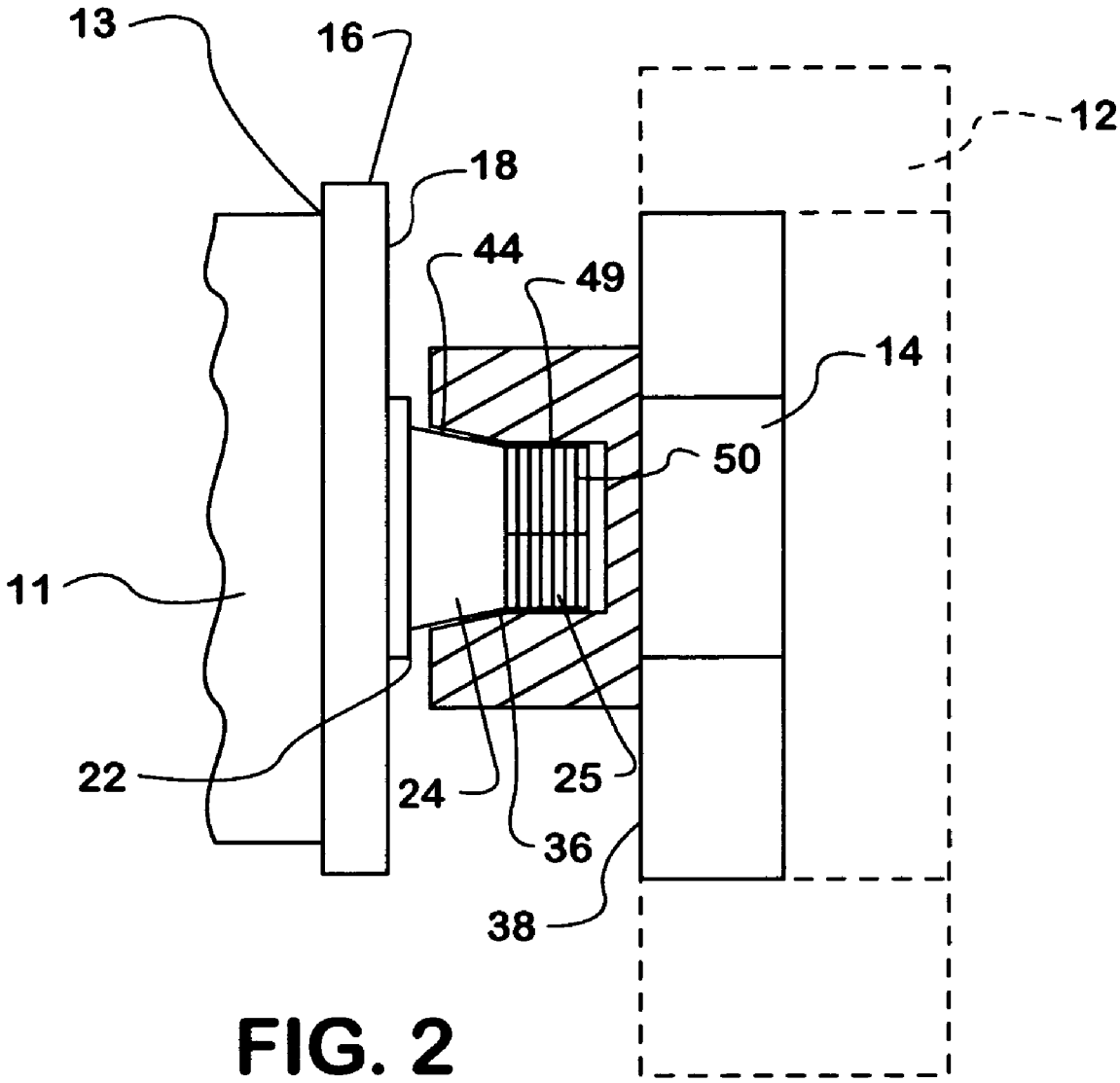
FIG. 2 is a partial close up exploded side view of a fan drive assembly of the invention with the fan in phantom.
Figure 3:
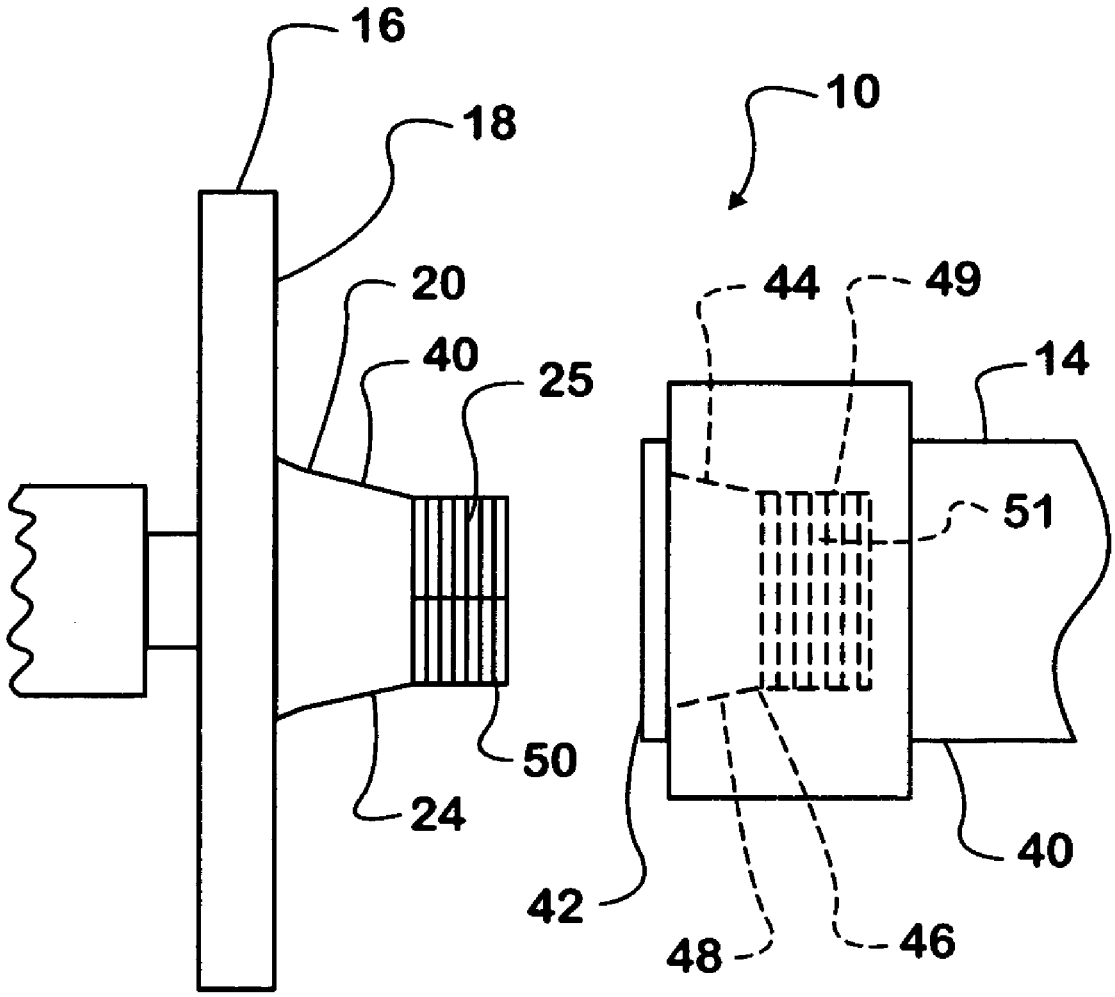
FIG. 3 is a partial close up exploded side view of a fan drive attachment assembly of the invention with the axial bore in phantom.
Figure 4:
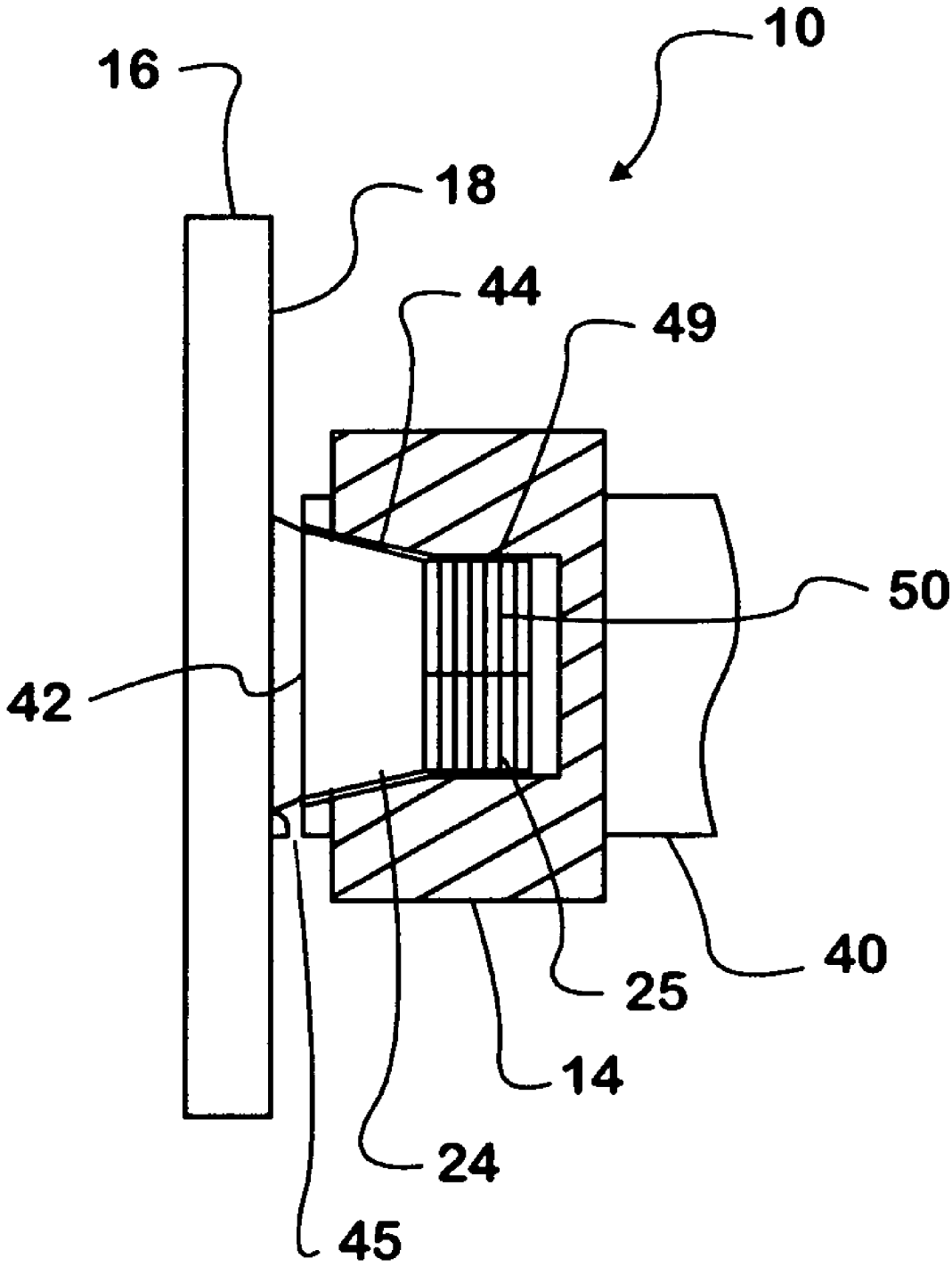
FIG. 4 is a partial cut-away view of a fan drive attachment assembly of the invention assembled.

Turning to the figures, fan assembly 13 connected to water pump 11 or a fan drive bearing assembly (not shown) for a motor vehicle, such as a medium or heavy duty truck, has fan 12, fan drive 14 and drive hub 16. Fan drive attachment assembly 10 has drive hub 16 matingly engaging fan drive 14. Drive hub 16 has radial front face 18 and tapered drive shank 20 projecting outwardly. Front face 18 can be flat. Drive shank 20 is at least partially tapered and can project outwardly from optional collar 22 adjacent front face 18. Drive shank can be smooth or at least partially threaded, if desired. Preferably, first portion 24 of drive shank 20 is proximal to and extends from front face 18. Second portion 25 is distal to front face 18 and can taper at a second pitch that is less than the pitch of first portion 24. Second portion 25 is preferably untapered or cylindrical. Second portion 25 can have threads 50.

Fan 12 has fan hub with vanes 28 extending outwardly from peripheral ring 30, and interior surface 32. Fan hub fastens to fan drive 14 with fasteners 34.

Radial fan drive 14 has fan drive surface 36 that engages the fan hub surface 32 of fan hub. Fan drive 14 has flat radial rear face 38 and outwardly projecting drive shaft 40 which can have cylindrical outer walls. Drive shaft 40 has inner wall 44 defining axial bore 46 and matingly engaging drive shank 20. Inner wall 44 extends inwardly from mouth 42 and is preferably at least partially tapered. Inner wall 44 can also be at least partially threaded, if desired. Inner wall 44 has an internal diameter dimensioned to easily fit drive shank 20 in frictional engagement.

Inner wall 44 can be dimensioned to mirror the shape of drive shank 20, such as by having tapered proximal end 48 proximal to mouth 42 and distal end 49 distal to mouth 42. Distal end 49 can be tapered at a second pitch less than the pitch of proximal end 48 and is preferably untapered or cylindrical. Distal end 49 can have threads 51. Distal end 49 of inner wall 44 and second portion 25 of drive shank 20 frictionally engage each other, such as by interlocking threads 50, 51 or by tightly fitting drive shank 20 within axial bore 46. Preferably, gap 45 forms between front face 18 or collar 22 of drive hub 16 and mouth 42 of drive shank 40.

The fan drive attachment assembly of the invention reduces misalignment of the drive hub and fan drive and the subsequent formation of detrimental shaking forces on the fan. The use of a tapered drive shank and axial bore reduces the possibility of misalignment. Yet, the use of the taper also makes it easy for the assembler to fit the parts together during assembly.

The use of the taper makes it easier to allow a tighter fit between the drive shank and the drive shaft's inner walls. If the fit is sufficiently tight, the threads could be eliminated and could thus decrease the cost of the parts.

While the invention is shown in only one of its forms, it is not thus limited but is susceptible to various changes and modifications without departing from the spirit and scope of the invention.

What is claimed is:

1. A fan drive attachment assembly for a motor vehicle fan, comprising:

a drive hub having an outwardly extending tapered drive shank;

a fan drive having a fan shaft;

the fan shaft having a mouth, and an inner wall extending inwardly from the mouth and defining an axial bore, the inner wall being tapered and frictionally engaging the drive shank;

the drive shank further comprises:

a tapered first portion; and a second portion tapered at a second pitch less than the taper of the first portion;

the inner wall further comprises:

a tapered proximal end proximal to the mouth; and an distal end distal to the mouth and tapered at a second pitch less than the taper of the proximal end;

a gap forms between the drive hub and drive shaft when the inner wall frictionally engages the drive shank; and wherein the second portion and the distal end are threaded.

2. A fan drive assembly for a motor vehicle comprising:

a drive hub having an outwardly extending tapered drive shank;

a fan drive with a fan shaft;

the fan shaft having a mouth and an inner wall extending from the mouth and defining an axial bore, the inner wall being tapered and frictionally engaging the drive shank;

a fan attached to the fan drive;

the drive shank further comprises:

a tapered first portion; and a second portion tapered at a second pitch less than the taper of the first portion;

the inner wall comprises:

a tapered proximal end proximal to the mouth; and an distal end distal to the mouth and tapered at a second pitch less than the taper of the proximal end;

a gap forms between the drive hub and drive shaft when the inner wall frictionally engages the drive shank; and wherein the second portion and the distal end are threaded.

3. A fan drive assembly for a motor vehicle comprising:

a drive hub having an outwardly extending tapered drive shank;

a fan drive with a fan shaft;

the fan shaft having a mouth and an inner wall extending from the mouth and defining an axial bore, the inner wall being tapered and frictionally engaging the drive shank;

a fan attached to the fan drive;

the drive shank further comprises:

a tapered first portion; and a second portion tapered at a second pitch less than the taper of the first portion;

the inner wall comprises:

a tapered proximal end proximal to the mouth; and an distal end distal to the mouth and tapered at a second pitch less than the taper of the proximal end;

a gap forms between the drive hub and drive shaft when the inner wall frictionally engages the drive shank; and a water pump connected to a drive hub.

4. A fan drive assembly for a motor vehicle comprising:

a drive hub having an outwardly extending tapered drive shank;

a fan drive having a fan shaft;

the fan shaft having a mouth and an inner wall extending from the mouth and defining an axial bore, the inner wall being tapered and frictionally engaging the drive shank;

a fan attached to the fan drive;

the drive shank further comprises:

a tapered first portion; and a second portion tapered at a second pitch less than the taper of the first portion;

the inner wall comprises:

a tapered proximal end proximal to the mouth; and an distal end distal to the mouth and tapered at a second pitch less than the taper of the proximal end;

a gap forms between the drive hub and drive shaft when the inner wall frictionally engages the drive shank; and a fan drive assembly connected to the drive hub.

* * * * *